US006502624B1

(12) United States Patent
Williams et al.

(10) Patent No.: US 6,502,624 B1
(45) Date of Patent: Jan. 7, 2003

(54) MULTIPROPERTY METAL FORMING PROCESS

(75) Inventors: Samuel B. Williams, Bloomfield Hills, MI (US); Timothy A. Nielsen, Walled Lake, MI (US)

(73) Assignee: Williams International Co., L.L.C., Walled Lake, MI (US)

( * ) Notice: Subject to any disclaimer, the term of this patent is extended or adjusted under 35 U.S.C. 154(b) by 0 days.

(21) Appl. No.: 09/551,105

(22) Filed: Apr. 18, 2000

(51) Int. Cl.[7] ..... B22D 19/16
(52) U.S. Cl. ..... 164/113; 164/61; 164/900
(58) Field of Search ..... 164/900, 312, 164/113, 61

(56) References Cited

U.S. PATENT DOCUMENTS

| | | | | |
|---|---|---|---|---|
| 3,596,708 | A | 8/1971 | Lapin | 164/343 |
| 4,154,286 | A | 5/1979 | Glazunov et al. | 22/17 |
| 4,510,987 | A | 4/1985 | Collot | 164/71.1 |
| 4,512,383 | A | 4/1985 | Suzuki et al. | 164/35 |
| 4,687,042 | A | 8/1987 | Young | 164/80 |
| 4,771,818 | A | 9/1988 | Kenney | 164/71.1 |
| 4,842,038 | A | 6/1989 | Fujino et al. | 164/80 |
| 5,299,619 | A | 4/1994 | Chandley et al. | 164/53 |
| 5,564,492 | A | 10/1996 | Preiss | 164/516 |
| 5,570,502 | A | 11/1996 | Sawtell et al. | 29/527.6 |
| 5,575,325 | A | 11/1996 | Sugiura et al. | 164/120 |
| 5,638,889 | A | 6/1997 | Sugiura et al. | 164/319 |
| 5,657,833 | A | 8/1997 | Freeman | 184/18 |
| 5,832,982 | A | 11/1998 | Williams et al. | 164/61 |
| 5,878,804 | A | 3/1999 | Williams et al. | 164/61 |
| 6,003,585 | A | 12/1999 | Williams et al. | 164/61 |

FOREIGN PATENT DOCUMENTS

| | | | |
|---|---|---|---|
| EP | 0 574 141 A1 | | 12/1993 |
| EP | 0569511 B1 | * | 1/1995 |
| JP | 2-59160 | | 2/1990 |
| JP | 3-13259 | | 1/1991 |
| JP | 08325652 | * | 10/1996 |

* cited by examiner

*Primary Examiner*—M. Alexandra Elve
*Assistant Examiner*—Len Tran
(74) *Attorney, Agent, or Firm*—Dinnin & Dunn, P.C.

(57) ABSTRACT

Methods for semisolid manufacturing of precision parts, turbine rotors for example, comprised of a plurality of high melting point alloys are given. Generally, a semisolid/thixotropic process is operated under vacuum utilizing a cooled mold. The process preferably comprises a vacuum chamber, inductive heaters to bring two or more high melting point slugs to either a solid or thixotropic phase, and a plunger that accelerates one or more high melting point solid slugs into one or more thixotropic slugs and then into a mold. Prior to heating, preconditioning at least one of the slugs to form a non-dendritic microstructure simplifies processing. The semisolid microstructure solidifies as the completed forged assembly cools. Thixotropic forging of a multi-alloy assembly achieves optimized properties in specific locations of the final product.

12 Claims, 3 Drawing Sheets

10

MULTIPROPERTY METAL FORMING PROCESS

BACKGROUND OF THE INVENTION

The present invention relates to methods of forming precision metal parts and, more specifically, to thixotropic forming of precision multi-alloy parts.

As performance criteria for turbine engines becomes more stringent, there is a need for an improved turbine rotor that exhibits maximum resistance to both fatigue and creep.

Die casting is a well-known process for producing complex components with excellent surface quality and good dimensional accuracy. However, the structural integrity of die castings is often compromised by air trapped in the casting upon injection of the liquid metal into the die casting cavity. The resultant porosity also compromises heat treatment of the casting that is often necessary to refine the grain structure and increase the strength of the casting.

Forging is also a well known process for producing relatively strong components having a desirable grain structure. However, forged products generally exhibit relatively low resistance to creep due to their fine grain structures.

Thixotropic, or semisolid, metal forming is a viable alternative to traditional casting and forging methods. This process lies somewhere between a casting and a forging process in that the metal to be formed is brought to a "thixotropic" state; that is, 30 or 40 percent of the mass exists in a liquid phase and the balance in a solid phase. The solid portion comprises small spherically-shaped nodules suspended within the liquid phase. Semisolid metals heated to a thixotropic state exhibit unique Theological properties due to their non-dendritic, or spherical, microstructure. The rheological properties of the semisolid metal range from high viscosities, like table butter, for alloys at rest, to low viscosities, such as machine oil, as the shearing rate of the semisolid slug is increased. By heating the metals to a semisolid range and then agitating the semisolid alloy, the dendritic microstructure normally found is eliminated and replaced by the spherical microstructure. Upon solidification, the alloys then exhibit a fine equiaxed microstructure.

Normally, a highly viscous thixotropic slug will retain its outer shape provided there are no external forces, other than gravity, applied to it. However, its butter-like consistency is easily deformed to a low viscosity, particularly by a shearing action such as high velocity impact, making it extremely suitable when driving the alloy into the mold during the manufacturing process. Because semisolid-formed alloys exhibit an intermediate-sized grain structure, larger than forged grains and smaller than cast grains, it is expected that semisolid forged or cast alloys will have improved creep rupture resistance over traditionally forged alloys and improved strength properties over traditionally cast alloys.

The thixotropic process has been extensively studied by others in relation to lighter metals or low melting point metals such as aluminum, magnesium, zinc, and copper alloys. In general, the low melting point metals have a melting point within the range of 750 to 1250 degrees Fahrenheit. On the other hand, lower melting point copper alloys (other than Cu—Ni alloys for example), have a melting point from 1200–1900 degrees Fahrenheit but are still within the scope of the present invention.

Very little research is available with regard to high temperature alloys commonly used in turbine rotors, including ferrous or nickel-based alloys. In general, high temperature alloys have a melting point range from 2000° F.–2700° F. One significant difference between semisolid production for lighter alloys and that for high temperature alloys involves the adaptation of the process to the problematic and high heating temperatures of 2500° F. to 2700° F. as opposed to alloys in the 750° F.–1250° F. melting point range. Designing a semisolid process compatible with such high heat has proven challenging. Generally, chrome-nickel alloys of, for example, 18% Cr and 82% Ni are used in turbine rotor forgings. This alloy has a solidus of 2550° F., and a liquidus of 2640° F. where the alloy is completely molten. The semisolid/thixotropic phase exists between the solidus and liquidus temperatures at temperatures ranging between 2550° F. and 2640° F. The alloy is commonly forged at temperatures below 2550° F., in the solid phase, and cast at molten temperatures above 2640° F., in the liquid phase.

Yet another problem is that current net-shape forging and die-casting equipment design includes permanent molds that often do not readily separate from the part interface when removing the turbine rotors and their intricate blades from the mold. This results in fractured or weakened blades and a corresponding number of rejected parts that do not meet design specifications. A need exists for semisolid manufacturing methods that facilitate ease of removal of the finished part, thereby improving the production volume and reducing the rejection rate of the finished parts.

Finally, precision metal assemblies are specifically designed to withstand various forces under uniquely stressful conditions. In certain applications, however, one part of a complete assembly may be exposed to stress and temperature loads significantly different from that of other parts integral to the same assembly. For example, the bore of a rotor may require good elongation, high strength, and good low cycle fatigue properties but may not require high temperature properties. In contrast, certain blade or rim portions of the rotor might require very high creep resistance and stress rupture strength at elevated temperatures. Formulating a single alloy capable of withstanding the variable stresses subjected to different locations within a precision metal assembly has also proven challenging.

DESCRIPTION OF THE RELATED ART

European Pat. No. 0 574 141 A1 entitled, "Thixoformable Layered Materials and Articles Made From Them", discloses a method of sequentially applying layers of substantially metallic material in a thixoforming process. The reference discloses a rotatable cylindrical collector that collects molten metal cooled by inert gases prior to concentric deposition on the collector. A thixotropic layer comprising 30–70% liquid is thereby formed as the atomized metal is sprayed onto the collector. Additional layers are then added in the same way that may or may not comprise the same alloy as found in the first layer. At least two of the layers have different properties. The layers may also comprise reinforcing materials such as ceramic, metallic, and intermetallic materials in spherical, fibrous, or any other shape. The reinforcing materials may be added by simply spraying them into the atomized melt spray during that stage.

EP 0 574 141 A1 discloses that a layered composition thixoformed by this method exhibits enhanced toughness and damage resistance due to the layered 3-dimensional structure. However, the method is labor intensive, for each layer must at least be melted, sprayed, cooled by inert gases, and then collected on the surface of the cylinder. The preforms formed by this method must then be cooled and cut to accommodate a thixoforming forging process, wherein a multiproperty component is manufactured.

U.S. Pat. Nos. 5,832,982, 5,878,804, and 6,003,585 to Williams et al. describe metal forming processes that form a semisolid slug or thixotropic solution containing 30–40% liquid and 60–70% solids. The slug is inductively heated to destroy the dendritic microstructure and when hardened results in a preferred fine equiaxed microstructure. A disadvantage of the processes, however, is that the slug must be heated to a point wherein the liquid percentage exceeds 40%, thereby ensuring destruction of the dendrites. As the liquid percentage increases, containment of the slug becomes exceedingly difficult and therefore complicates the process. Increased amounts of energy and time are also required to heat the slugs and destroy the dendrites.

U.S. Pat. No. 5,878,804 obviates the containment problem by heating the slug within a mold. Nevertheless, increased amounts of energy and time are still required for dendrite destruction. Cooling of the finished product is also more difficult when using a heated mold.

Finally, U.S. Pat. No. 6,003,585 also requires the manufacture of a multialloy slug to similarly accomplish the objects of the present invention.

Therefore, a need exists for a simplified and cost-effective thixotropic manufacturing method that can be modified to vary the properties of different parts integral to a complete assembly.

SUMMARY OF THE INVENTION

The present invention solves the aforementioned problems by implementing a thixotropic process under vacuum for the production of turbine rotors and other parts of intricate design that comprise high melting point alloys. The mechanical properties of semisolid forgings are tailored by microstructure or metallurgical chemistry to achieve optimized properties in specific locations of the final product.

Initially, two or more high temperature slugs are first machined or preformed to fit within a heater in the metal forming process. The slugs are generally comprised of the same or different alloys and may be heated to a semisolid or solid state depending on design criteria.

In a first embodiment of the process, a first slug is heated under vacuum but retained as a solid. A second slug is also under vacuum and is heated to a thixotropic or semisolid state. Once the desired liquid/solid thixotropic ratio is attained within the second slug, the solid and semisolid slugs are forged into the mold. Upon actuation of a piston or plunger, the solid slug is driven into the semisolid slug. The semisolid slug thus enters the mold and is then exuded into predetermined areas upon the subsequent entry of the solid slug. The areas receiving the semisolid slug thereby benefit from its respective properties once the completed assembly hardens, and the areas occupied by the solid slug(s) benefit from its respective properties once the assembly is completely forged.

The process described is particularly well suited for manufacturing turbine assemblies comprised of integrated bore, rim, and blade components. For example, to form a rotor assembly, a first slug containing a bore alloy may be heated but remain in the solid state within a heater. A second slug, axially aligned with the first slug, contains a blade and rim alloy and is simultaneously and independently heated to a thixotropic state within the heater. After the heating step, a piston or other means drives the solid (first) slug into the thixotropic (second) slug, whereby the thixotropic slug enters the mold and is then followed by the solid slug. The solid slug thus forces the semisolid slug to exude into predetermined outer rim and blade areas of the mold. The solid slug, on the other hand, remains within the central or bore region of the finished part. It should be appreciated that one or more solid slugs may be accelerated into one or more semisolid slugs depending on design criteria.

Modified equipment design may be utilized in alternate embodiments of the high melting point semisolid process.

DETAILED DESCRIPTION OF THE PREFERRED EMBODIMENT(S)

Figure 1:
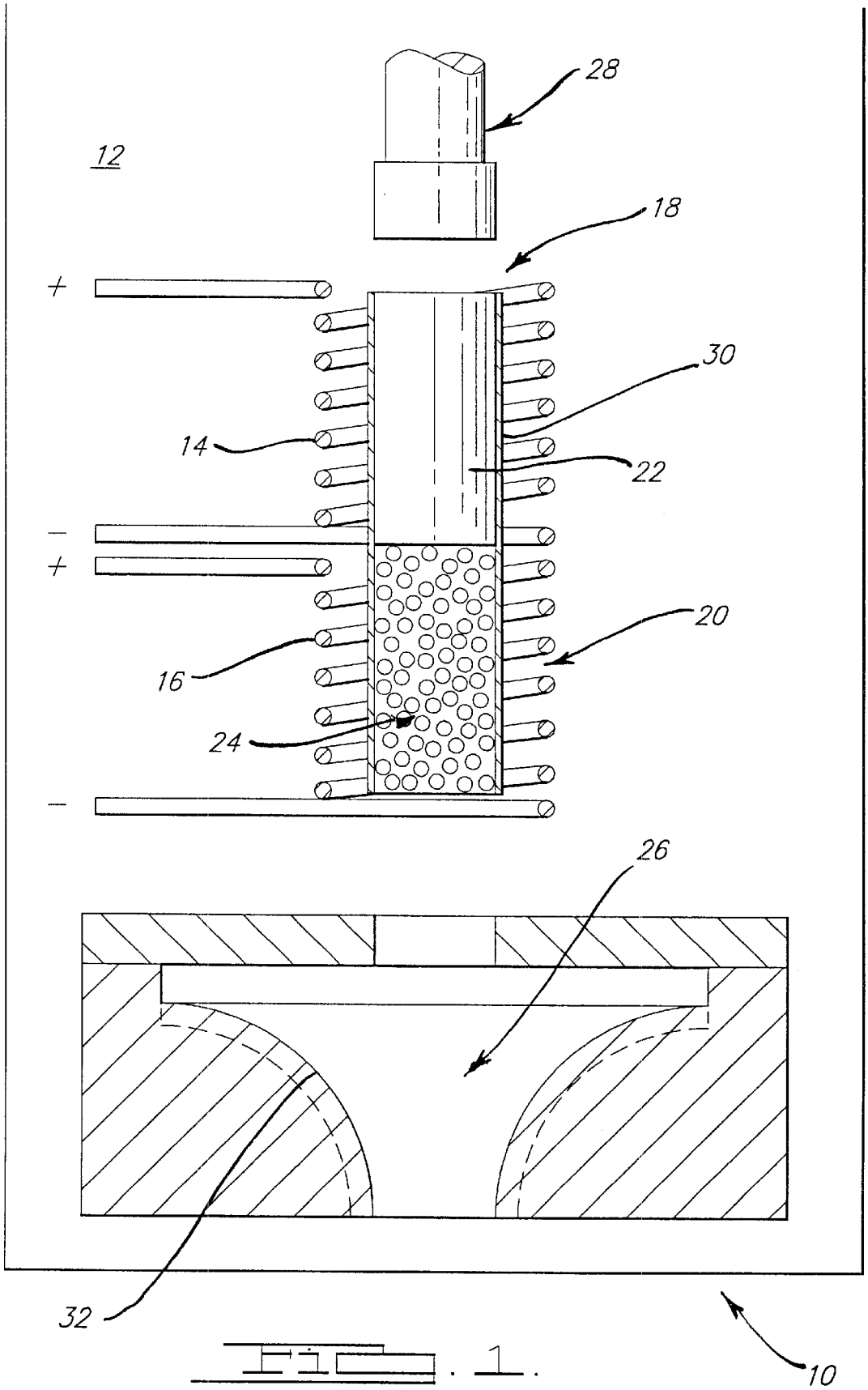
FIG. 1 illustrates the thixotropic process during the heating stage of high temperature first and second slugs, heated to a solid and semisolid state, respectively.
Figure 2:
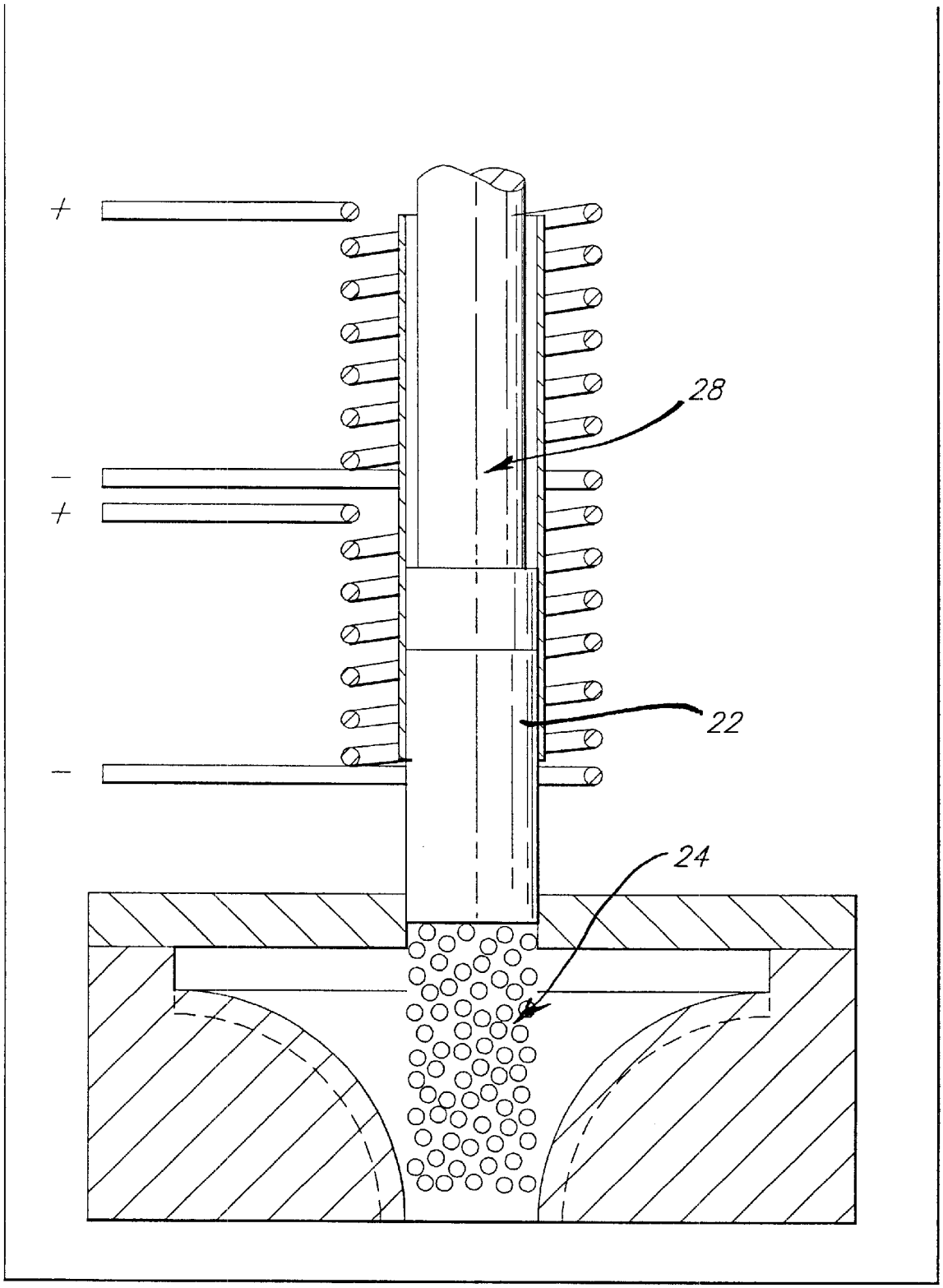
FIGS. 2 and 3 illustrate the acceleration and injection of the solid and semisolid slugs into a mold.
Figure 3:
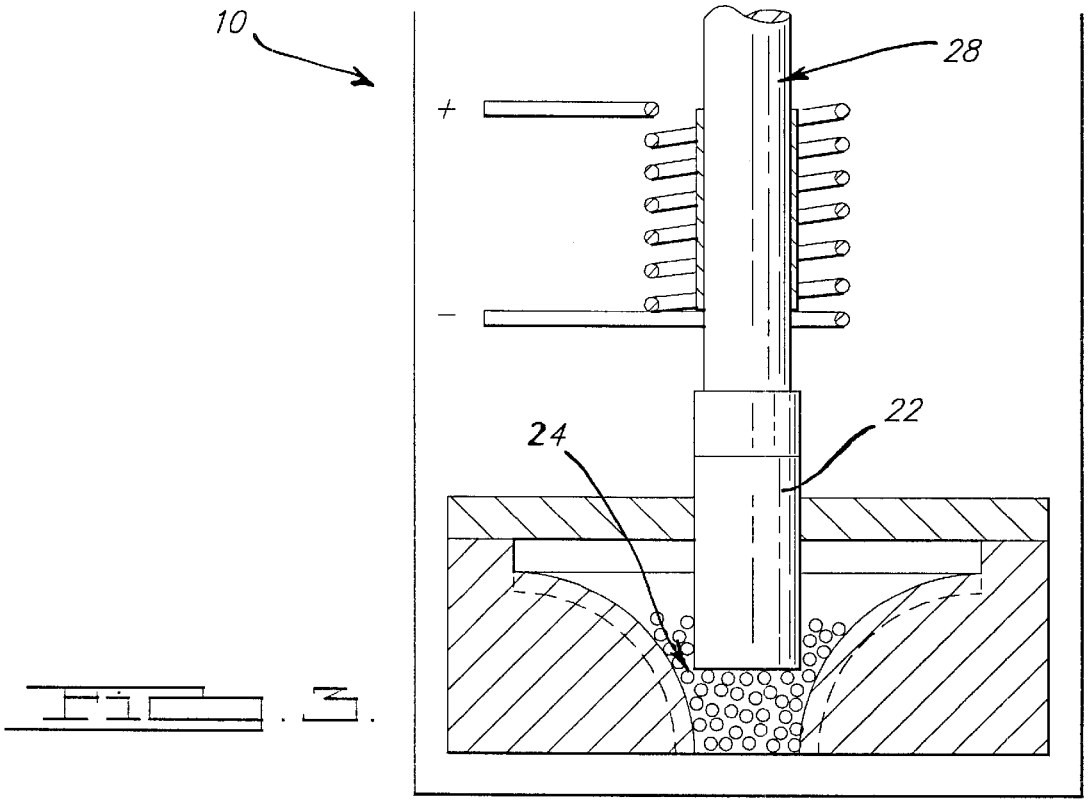
Figure 4:
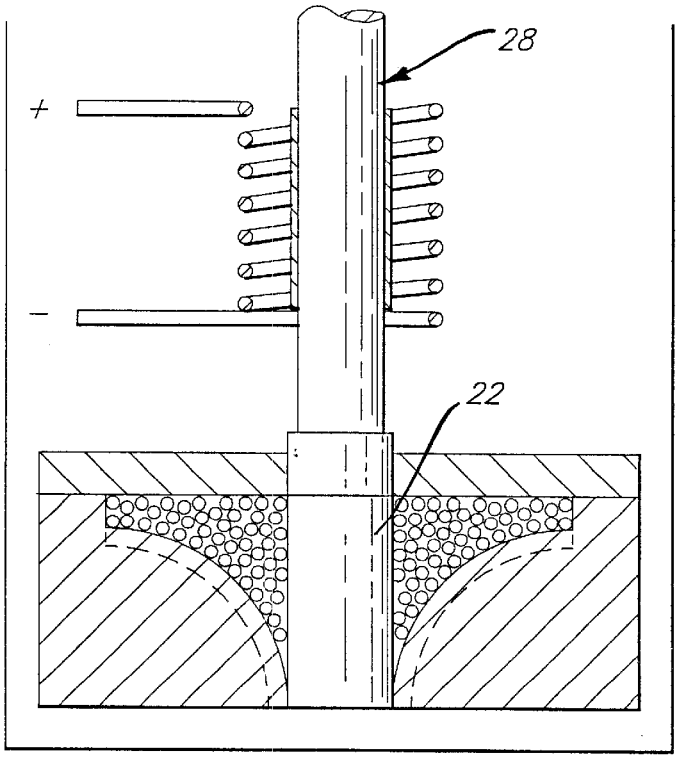
FIG. 4 illustrates the thixotropic process during the forming and solidification of the completed forged assembly, wherein the solid slug forms the bore and the semisolid slug forms the periphery of the finished part.
Figure 4:
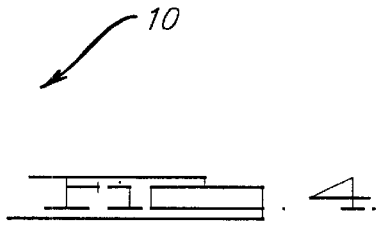

In accordance with the present invention, a semisolid forging/casting process 10 is illustrated in the drawings, as it exists within a vacuum chamber 12. In accordance with a preferred embodiment of the present invention, electrical inductive heaters 14 and 16 are located at upper and middle sections 18 and 20, respectively, of the chamber 12. Induction heat elements 14 line the upper section 18 generating a uniform heat throughout the upper section 18 thereby heating a first slug 22 therein. Inductive heating elements 16 line section 20 thereby independently and simultaneously heating a second slug 24 within section 20. Induction heater 16 serves to heat a pre-conditioned second slug quickly and uniformly creating a solid/liquid mixture that exhibits thixotropic behavior.

Induction heating can be used to heat and stir a semisolid material to break up a dendritic microstructure. However, a larger amount of liquid phase would be needed to achieve the fluidity required to eliminate the dendrite microstructure. Thus, containment of the slug becomes more difficult. It therefore becomes more efficient to pre-condition a cast slug to break up its dendritic microstructure prior to the forming steps or to select a slug with the desirable equiaxed microstructure characteristics (such as a fine-grained powder metal pre-form).

"Preconditioned" as described herein, indicates a preformed slug conditioned to have a fine non-dendritic microstructure. The slug can be preconditioned by several routes. Massachusetts Institute of Technology has used mechanical stirring to break up the dendrites when preforming a metal slug. Electromagnetic stirring is also used.

Thermal spraying, sintered powder preforms, or highly cold worked and recystallized metals are exemplary methods for developing a preformed slug with a non-dendritic microstructure.

A mold 26 is located at the lower end of the vacuum chamber 12. The turbine blade portions of the mold are downwardly and bottomly positioned in the mold wherein an upper part of the mold is open-faced thereby allowing injection of the thixotropic alloy.

Before implementing the process, the slugs of high temperature alloys should first be machined to the approximate shape of the disc portion of the turbine with additional stock left on the back side of the disc shape. The excess stock should be great enough to more than fill the turbine blade cavities between the die segments when the slugs 22 and 24 are forged into the die 26. Additional solid or semisolid slugs may also be incorporated into the process as described above.

In operation, the entire manufacturing process is conducted in a vacuum chamber to eliminate oxidation of the high temperature alloy and furthermore, to avoid formation of air pockets as the thixotropic second slug is accelerated into the die cavity. By decreasing the air pockets, porosity is decreased providing a fully dense component that is strengthened by subsequent heat treat operations.

As shown in FIG. 1, a first metallic slug 22 is inserted into section 18, immediately beneath a plunger 28, and heated but retained as a solid. Concurrently, a second metallic slug 24 is inserted into section 20 and quickly and uniformly heated (about three minutes or less) to a thixotropic state. Once the desired liquid/solid thixotropic ratio (preferably 60–70% solids) is attained within the second slug 24, the solid and semisolid slugs are forged into the mold. In a preferred embodiment, the first and second slugs are axially aligned. The solid slug 22 is positioned in section 18 to ensure that upon forging, the semisolid slug 24 enters the mold 26 first. The solid slug 22 then follows thereby exuding the semisolid metal from slug 24 into the outer areas of the mold 26. The areas receiving the semisolid slug benefit from its respective properties once the completed assembly fully solidifies, and the areas occupied by the solid slug(s) benefit from its respective properties once the assembly is completely forged.

The process described is particularly well suited for manufacturing turbine assemblies comprised of integrated bore, rim, and blade components. For example, to form a rotor assembly, a first slug containing a bore alloy may be heated but remain in the solid state within a heater. A second slug, axially aligned with the first slug, contains a blade and rim alloy and is simultaneously and independently heated to a thixotropic state within the heater. After the heating step, a plunger or other forging means drives the solid (first) slug 22 into the thixotropic (second) slug 24, whereby the semisolid slug 24 enters the mold 26 first and is then followed by the solid slug 22. The solid slug 22 thus forces the semisolid slug 24 into the outer rim and blade areas of the mold. By design, the solid slug 22 remains within the central or bore region of the finished part.

As the molded assembly cools, the thixotropic or semisolid microstructure solidifies. The solidified alloy now possesses the properties advantageous in both the forging and casting processes such as high creep resistance, high strength, and low cycle fatigue resistance, and yet exhibits less shrinkage and gas porosity than castings.

Several features of the preferred method presented may be altered in various ways. For example, in lieu of a plunger 28, the acceleration step might include an electrical cannon or linear acceleration through an electric field as a method of driving the thixotropic rotor material into the mold 26. Alternatively, a vertical transfer tube 30 extending from the upper induction heater 14 to the bottom mold 26 provides a gravitational means of acceleration. The vacuum chamber may incorporate a long vertical tube from 20 to 80 feet in height, having the inductive heaters at an upper end and heating elements lining the length of the vertical tube, thereby ensuring homogeneous heating throughout the tube. The solid and thixotropic slugs are then dropped accelerating to high velocity before impacting into the open face of the die. When the tapered disc shape of the semisolid slug 24 impacts the die 26, the metal is extruded into turbine blade cavities within the die 26. This shearing action takes place at high velocity with the flow being equivalent to that of a low viscosity fluid. The solid slug then further displaces the semisolid metal from the central or bore region of the die 26.

Once the shearing action stops, the viscosity increases and the part tends to hold its new shape. The surfaces in contact with the die are cooled rapidly to further retain shape integrity. As soon as the die is filled, the metal is trapped within because of the geometry of the blade shapes. As such, the metal will not tend to bounce upwardly and out of the die.

The heaters 14 and 16 may provide heat in a variety of ways. Although the preferred embodiment utilizes an induction heater to rapidly and uniformly heat the high temperature rotor material, other heating methods include electrical resistive heating methods. The heating method is critical to the rapid and uniform heating of the material and to minimize its time at temperature to prevent an undesirable dendritic microstructure from forming.

"Time at temperature" is a term of art that refers to the heating step of the slug. Rapid and uniform heating will bring the entire slug to the desired temperature as quickly as possible (i.e. low "time at temperature"). A relatively higher time at temperature may be caused by a slower or non-uniform heating rate. The slug must then be held at an elevated temperature for an extended period of time to achieve a tight and uniform temperature profile. The longer the slug is held at elevated temperatures (i.e. the longer the time at temperature), the courser the microstructure will become. In the worst case, dendrites might actually begin growing rather than being eliminated. Courser grains and/or the growth of dendrites may be prevented by reducing the time at elevated temperatures as much as possible.

Once the inductively heated alloy has attained a thixotropic phase, if the die 26 is formed from a low-melting point alloy (below 800 degrees Fahrenheit) containing lead, tin, zinc, copper, antimony, bismuth, indium or a mixture thereof, the die 26 is cryogenically cooled by a jacket 32 to a reduced temperature of approximately −100° F. to −320° F. As discussed below, mold design may vary and depending on its design, the mold 26 may be cooled to approximately −100° F. to −320° F. for low melting point alloy molds, or, 1500° F. to 2000° F. for permanent high melting point molds. The cooling of the low melting point die increases its hardness and permits slug extrusion into the mold cavities without erosion of the mold's surface, despite the high velocity of the slug. Immediately thereafter, the plunger 28 forcefully accelerates and injects the solid and thixotropic slugs into the open-faced die 26. The plunger 28 and the heaters 14 and 16 may also be positioned below the die 26 wherein the high melting point slugs are then upwardly accelerated into the inversely positioned die 26, thereby providing added control over the acceleration of the alloy.

The removable mold 26 is located at the lower end of the vacuum chamber 12. As discussed above, the mold 26 should either be completely removable or comprise segments that can be retracted, electrically for example, upon solidification of the molded part. In the preferred embodiment, the mold consists of a low melting point-alloy comprised of metals such as lead, tin, copper, antimony, bismuth, indium, or zinc, that when exposed to high heat is designed to melt away from the high temperature alloy and provide a finished part. Thus, immediately after injecting the metal slugs into the mold, cooling of the mold ceases. The heat within the metal slugs is then transferred to the low melting point mold, whereby the mold shortly thereafter reaches its melting point and falls from the finished part. Cooling of the finished part is sufficient to retain its desired shape.

The turbine blade portions of the mold are downwardly and bottomly positioned in the mold wherein the upper part of the mold is open-faced thereby allowing injection of the thixotropic alloy. The cooling jacket 32 surrounds and cools the mold 26. The mold 26 may be cooled by various means such as, for example, water cooling passages, cold air blasts, or sub-zero $CO_2$ blasts within the cooling jacket 32. The plunger 28 is located at the upper end of the vacuum chamber 12 and is actuated by pneumatic, electrical, hydraulic, mechanical or other means.

Finally, the solidification and forming step may utilize a permanent mold 26 comprising high melting point alloy segments or half-segments that may be electrically and radially retracted upon solidification of the molded part. The mold segments may also be retracted by other means including pneumatic or hydraulic force, but segment removal by electric actuation through high strength solenoids, for example, is preferred thereby ensuring vacuum integrity. The extraction should be high in velocity, leaving the high temperature slug in contact with the die 26 only for an instant to prevent overheating of the die segments. The permanent mold 26 is continuously cooled to maintain a temperature between 1500° F. to 2000° F. Even with very short-term contact between the hot high temperature alloy and the die segments, the high temperature alloy surface in intimate contact with the cooled die will drop in temperature extremely rapidly, thereby maintaining the designed shape of the part as the segments are extracted.

Continuous cooling of the permanent mold before, during, and after injection of the slug provides rapid cooling, rapid part removal, and rapid cycling and improved net-shape production rates. Once the part is removed, the segments are automatically reinserted in preparation for the next production cycle. In sum, the area surrounding the die is kept at a relatively low temperature to ensure quick cooling of the permanent mold before the next cycle.

In addition, the mold may alternatively consist of disposable precision injected molded plastic or expendable ceramic, cooled just prior to injection. The process would not require actuation means but would require separation of the disposable plastic or ceramic mold from the solidified alloy once the combined finished part and mold had been removed from the process and cooled.

Depending on designed properties of the finished part, the thixotropic process may comprise various solid/liquid percentages by adjustments in thermal processing. Stated another way, the temperature may be increased or decreased within the semisolid temperature range resulting in more or less of a liquid interphase, and variations in the final grain structure. This provides design flexibility and variability of the blade and bore properties of the rotor, thereby resulting in an optimum combination of mechanical properties tailored for specific applications.

While the preferred embodiment of the invention has been disclosed, it should be appreciated that the invention is susceptible of modification without departing from the scope of the following claims.

We claim:

1. A thixotropic shaping method of forming a multi-property high melting point metal part comprising the steps of:

inserting a first high melting point metal slug within a first end of a vacuum chamber;

preconditioning a second high melting point metal slug to form a non-dendritic, fine and equiaxed microstructure;

inserting the second high melting point metal slug within the first end of said vacuum chamber wherein said first and second high melting point metal slugs are axially aligned;

creating a vacuum within the vacuum chamber;

heating the first slug as a solid;

heating the second slug to form a semisolid metal consisting essentially of a non-dendritic microstructure;

cooling a removable die located at a second end of the vacuum chamber;

accelerating the first slug into the second slug to accelerate the slugs into the die;

cooling the semisolid metal and the solid metal within the die thereby solidifying the high melting point metal therein; and removing the solidified multiproperty high melting point metal part from the die.

2. The method of claim 1, wherein the second slug is heated to form a semisolid metal comprising about 60–70% solids.

3. The method of claim 1 wherein said accelerating step comprises:

accelerating the first slug into the second slug and then into the die by actuating a pneumatic plunger.

4. The method of claim 1, wherein said accelerating step comprises gravitationally accelerating and injecting the slugs into the die.

5. The method of claim 1, wherein said accelerating step comprises accelerating and injecting the slugs into the die by utilizing an electric cannon, and generating linear acceleration through an electric field.

6. The method of claim 1 wherein the second slug is inductively heated.

7. The method of claim 1, wherein said removable die comprises a plurality of removable and replaceable segments, and said cooling the removable die comprises cooling said die before, during, and after injection of the high melting point metal, thereby continuously maintaining a temperature between 1500° F. to 2000° F. in and around said die.

8. The method of claim 7, wherein said removal step comprises removing said plurality of segments of said die by actuating a plurality of corresponding electronic solenoids, after acceleration of the semisolid solution into said die, and then removing the metal part from said process.

9. The method of claim 1, wherein said removable die is formed from precision injected molded plastic, wherein said removal step comprises:

removing said die and the attached solidified high melting point metal part, as a unit, from said vacuum chamber;

cooling the unit; and separating said die from the solidified metal part.

10. The method of claim 1, wherein said removable die is formed from a material selected from the group consisting of lead, tin, copper, antimony, bismuth, indium, zinc, and alloys thereof, and, said removal step comprises removing the low melting point die by allowing the die to melt and fall free from the high melting point solidified metal part.

11. A thixotropic shaping method of forming a multi-property high melting point metal part comprising the steps of:

inserting a first high melting point metal slug within a first end of a vacuum chamber;

inserting a second high melting point sintered powder metal slug within the first end of said vacuum chamber wherein said first and second high melting point metal slugs are axially aligned and said second high melting point metal slug consists essentially of a non-dendritic microstructure;

creating a vacuum within the vacuum chamber;

heating the first slug as a solid;

heating the second slug to form a non-dendritic semisolid metal;

cooling a removable die located at a second end of the vacuum chamber;

accelerating the first slug into the second slug to accelerate the slugs into the die;

cooling the semisolid metal and the solid metal within the die thereby solidifying the high melting point metal therein; and removing the solidified multiproperty high melting point metal part from the die.

12. A thixotropic shaping method of forming a multiproperty high melting point metal part comprising the steps of:

inserting a first high melting point metal slug within a first end of a vacuum chamber;

inserting a second high melting point metal slug within the first end of said vacuum chamber wherein said first and second high melting point metal slugs are axially aligned and said second slug is cold worked and recrystallized to form a non-dendritic microstructure therein;

creating a vacuum within the vacuum chamber;

heating the first slug as a solid;

heating the second slug to form a non-dendritic semisolid metal;

cooling a removable die located at a second end of the vacuum chamber;

accelerating the first slug into the second slug to accelerate the slugs into the die;

cooling the semisolid metal and the solid metal within the die thereby solidifying the high melting point metal therein; and removing the solidified multiproperty high melting point metal part from the die.

* * * * *